US007140605B2

(12) United States Patent
Suga et al.

(10) Patent No.: US 7,140,605 B2
(45) Date of Patent: Nov. 28, 2006

(54) SHEET FEEDING APPARATUS AND IMAGE FORMING APPARATUS EQUIPPED WITH THIS SHEET FEEDING APPARATUS

(75) Inventors: Takeshi Suga, Ibaraki (JP); Seiichiro Adachi, Chiba (JP); Hiroto Koga, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/916,557

(22) Filed: Aug. 12, 2004

(65) Prior Publication Data

US 2005/0046104 A1 Mar. 3, 2005

(30) Foreign Application Priority Data

Aug. 26, 2003 (JP) ..... 2003-301028

(51) Int. Cl.
*B65H 3/14* (2006.01)

(52) U.S. Cl. ..... 271/97

(58) Field of Classification Search ..... 271/97, 271/31, 108, 30.1

See application file for complete search history.

(56) References Cited

U.S. PATENT DOCUMENTS

| | | | | |
|---|---|---|---|---|
| 5,290,023 | A * | 3/1994 | Sasaki et al. | 271/20 |
| 5,546,168 | A | 8/1996 | Adachi et al. | 355/233 |
| 5,678,127 | A | 10/1997 | Suga | 399/45 |
| 5,700,002 | A | 12/1997 | Kato et al. | 270/58.12 |
| 6,015,144 | A | 1/2000 | Yoshii et al. | 271/97 |
| 6,059,285 | A | 5/2000 | Suga et al. | 271/228 |
| 6,260,840 | B1 | 7/2001 | Suga et al. | 271/10.12 |
| 6,276,677 | B1 | 8/2001 | Hommochi et al. | 270/32 |
| 6,290,225 | B1 * | 9/2001 | Linder et al. | 271/155 |
| 6,298,214 | B1 | 10/2001 | Koga | 399/322 |
| 6,354,585 | B1 * | 3/2002 | Takahashi | 271/97 |
| 6,460,846 | B1 * | 10/2002 | Yow et al. | 271/155 |
| 6,609,708 | B1 * | 8/2003 | Moore et al. | 271/98 |
| 2003/0170059 | A1 | 9/2003 | Koga et al. | 399/381 |
| 2004/0081496 | A1 | 4/2004 | Endo et al. | 399/390 |
| 2004/0089994 | A1 | 5/2004 | Koga et al. | 271/98 |

FOREIGN PATENT DOCUMENTS

| | | | |
|---|---|---|---|
| JP | 7-187422 | * | 7/1995 |
| JP | 11-5643 | | 1/1999 |
| JP | 2001-48366 | | 2/2001 |

* cited by examiner

*Primary Examiner*—Patrick Mackey
*Assistant Examiner*—Thomas A. Morrison
(74) *Attorney, Agent, or Firm*—Fitzpatrick, Cella, Harper & Scinto

(57) ABSTRACT

It is one objective of the present invention to provide a sheet feeding apparatus that can steadily separate and feed individual sheets without causing an image detect, such as a transfer failure. The sheet feeding apparatus, for employing a sheet feeding portion to feed sheets stacked on elevatable sheet stacking means, includes an air blowing portion for blowing air against an end face of a sheet stack supported by the sheet stacking means, a sheet position detector for detecting that a top face of the sheet stack has reached a position whereat a sheet feeding operation by the sheet feeding portion is enabled, wherein, when the sheet position detector has detected that the top face of the sheet stack has reached the position for sheet feeding, or when the sheet feeding portion starts the sheet feeding operation, and when a sheet is not actually fed after a predetermined waiting time has elapsed, the air blowing portion starts an air blowing operation during a predetermined air blowing period.

9 Claims, 18 Drawing Sheets

RELATIONSHIP BETWEEN ATTRACTIVE FORCE AND RELATIVE HUMIDITY (TEMPERATURE IS 30°C)

TEMPORAL CHANGE OF ATTRACTIVE FORCE
(ENVIRONMENT: 30℃ - 80%)

TEMPORAL CHANGE OF ATTRACTIVE FORCE
AFTER RAVELLING-OUT (ENVIRONMENT: 30℃ - 80%)

FIG. 10

CONTROL TABLE OF INITIAL SWING TIME (T1)

| | | | | | | | | | |
|---|---|---|---|---|---|---|---|---|---|
| EQUAL TO OR MORE THAN 80% | 30 SEC | 30 SEC | 30 SEC | 30 SEC | 30 SEC | 30 SEC | 50 SEC | 50 SEC | 50 SEC |
| 70% | 30 SEC | 30 SEC | 30 SEC | 30 SEC | 30 SEC | 30 SEC | 30 SEC | 30 SEC | 30 SEC |
| 60% | 20 SEC | 20 SEC | 20 SEC | 20 SEC | 20 SEC | 30 SEC | 30 SEC | 30 SEC | 30 SEC |
| 50% | 10 SEC | 10 SEC | 15 SEC | 15 SEC | 15 SEC | 20 SEC | 20 SEC | 20 SEC | 20 SEC |
| 45% | 5 SEC | 5 SEC | 10 SEC | 10 SEC | 10 SEC | 15 SEC | 15 SEC | 15 SEC | 15 SEC |
| 40% | 0 SEC | 5 SEC | 5 SEC | 5 SEC | 5 SEC | 5 SEC | 5 SEC | 10 SEC | 10 SEC |
| EQUAL TO OR LESS THAN 30% | 0 SEC | 0 SEC | 0 SEC | 5 SEC | 5 SEC | 5 SEC | 5 SEC | 5 SEC | 5 SEC |
| HUMIDITY / TEMPERATURE | EQUAL TO OR LESS THAN 5℃ | 10℃ | 15℃ | 20℃ | 30℃ | 40℃ | 45℃ | 50℃ | EQUAL TO OR MORE THAN 60℃ |

FIG. 11

CONTROL TABLE OF PRE-JOB SWING TIME (T2)

| | | | | | | | | | |
|---|---|---|---|---|---|---|---|---|---|
| EQUAL TO OR MORE THAN 80% | 10 SEC | 10 SEC | 10 SEC | 10 SEC | 10 SEC | 10 SEC | 10 SEC | 10 SEC | 10 SEC |
| 70% | 8 SEC | 8 SEC | 8 SEC | 8 SEC | 8 SEC | 10 SEC | 10 SEC | 10 SEC | 10 SEC |
| 60% | 5 SEC | 5 SEC | 5 SEC | 5 SEC | 5 SEC | 8 SEC | 8 SEC | 8 SEC | 8 SEC |
| 50% | 5 SEC | 5 SEC | 5 SEC | 5 SEC | 5 SEC | 5 SEC | 5 SEC | 5 SEC | 5 SEC |
| 45% | 3 SEC | 3 SEC | 3 SEC | 3 SEC | 5 SEC | 5 SEC | 5 SEC | 5 SEC | 5 SEC |
| 40% | 2 SEC | 2 SEC | 2 SEC | 2 SEC | 2 SEC | 2 SEC | 4 SEC | 4 SEC | 4 SEC |
| EQUAL TO OR LESS THAN 30% | 0 SEC | 0 SEC | 0 SEC | 0 SEC | 0 SEC | 0 SEC | 0 SEC | 0 SEC | 0 SEC |
| HUMIDITY / TEMPERATURE | EQUAL TO OR LESS THAN 5℃ | 10℃ | 15℃ | 20℃ | 30℃ | 40℃ | 45℃ | 50℃ | EQUAL TO OR MORE THAN 60℃ |

FIG. 12

CONTROL TABLE OF HEATER 6 TEMPERATURE CONTROL FOR COATED SHEET

| | | | | | | | | | |
|---|---|---|---|---|---|---|---|---|---|
| EQUAL TO OR MORE THAN 80% | 85℃ | 85℃ | 85℃ | 85℃ | 85℃ | 85℃ | 85℃ | 85℃ | OFF |
| 70% | 80℃ | 80℃ | 80℃ | 80℃ | 85℃ | 85℃ | 85℃ | 85℃ | OFF |
| 60% | 70℃ | 70℃ | 70℃ | 70℃ | 80℃ | 80℃ | 80℃ | 80℃ | OFF |
| 50% | 65℃ | 65℃ | 65℃ | 65℃ | 65℃ | 70℃ | 70℃ | 70℃ | OFF |
| 45% | 60℃ | 60℃ | 60℃ | 60℃ | 60℃ | 65℃ | 65℃ | 65℃ | OFF |
| 40% | OFF | OFF | OFF | OFF | OFF | OFF | OFF | OFF | OFF |
| EQUAL TO OR LESS THAN 30% | OFF | OFF | OFF | OFF | OFF | OFF | OFF | OFF | OFF |
| HUMIDITY / TEMPERATURE | EQUAL TO OR LESS THAN 5℃ | 10℃ | 15℃ | 20℃ | 30℃ | 40℃ | 45℃ | 50℃ | EQUAL TO OR MORE THAN 60℃ |

FIG. 13

TIME CONTROL TABLE

| HUMIDITY | OPERATION INTERVAL T3 ON WAITING | SWING OPERATION TIME T4 ON WAITING | SWING OPERATION STOP TIME T5 ON JOB |
|---|---|---|---|
| EQUAL TO OR MORE THAN 80% | 10 MIN | 30 SEC | 20 SEC |
| 70% | 30 MIN | 20 SEC | 15 SEC |
| 60% | 2 HR | 10 SEC | 10 SEC |
| 50% | 5 HR | 10 SEC | 5 SEC |
| 45% | 10 HR | 3 SEC | 3 SEC |
| 40% | WITHOUT ASSIST OPERATION ON STANDBY | | 0 SEC |
| EQUAL TO OR LESS THAN 30% | | | 0 SEC |

SHEET FEEDING APPARATUS AND IMAGE FORMING APPARATUS EQUIPPED WITH THIS SHEET FEEDING APPARATUS

BACKGROUND OF THE INVENTION

1. Field of the Invention

The present invention relates to a sheet feeding apparatus and an image forming apparatus equipped with this sheet feeding apparatus, and particularly to a configuration for separating sheets that tend to stick to each other and feeding individual sheets.

2. Related Background Art

A conventional image forming apparatus, such as a copier or a printer, includes a sheet feeding apparatus wherein sheets stacked on sheet stacking means are sequentially fed, beginning with the uppermost sheet, by sheet feeding means, which is a pickup roller, and are separated by a sheet separating portion and individually supplied to an image forming portion.

Cut sheets, generally of high-quality paper or of a standard paper designated by a copier maker, are employed for the sequential feeding performed by a thus arranged sheet feeding apparatus. And to steadily separate and feed cut sheets individually, various sheet separating systems have been employed, such as a sheet separating pad system that, to prevent the double feeding of sheets, brings a friction member into contact with a feed roller.

As another separating system, there is a retard separating system wherein a separating portion is constituted by a feed roller, which is rotated in a sheet conveying direction, and a separating roller, which is driven at a predetermined torque in a direction opposite to the sheet conveying direction and which contacts the feed roller under a predetermined pressure, and wherein the separating portion passes only the uppermost sheet of a stack of sheets that is fed by a pickup roller, and returns, toward the sheet mounting means, other sheets that accompany the uppermost sheet, so that double feeding is prevented.

When one of the sheet separating systems, such as a retard separating system, is employed to steadily separate and individually feed sheets, a return torque and a pressurization force for a separation roller are optimized while taking the friction force of a sheet into account.

Recently, as the variety of types of sheets (recording media) has increased, the demand has likewise increased for the forming of images not only on very thick paper, OHP sheets and art films, but also on coated sheets, for which a surface coating process has been performed to obtain white and glossy colors that satisfy market demands for color.

However, when very thick paper is to be fed, it can not be picked up because the weight of the paper resists its conveyance, and a paper jam occurs. Further, when resin sheets, such as OHP sheets and art films, that tend to acquire a charge are to be fed in a low relative humidity environment, the surfaces of the sheets are gradually charged by rubbing against other sheets, and a Coulomb force causes then to attract to each other. As a result, either a sheet cannot be picked up, or the double feeding of sheets occurs.

Furthermore, a property of coated sheets the surfaces of which are covered with a coating material, is that when stacked they attract to each other, especially in a high relative humidity environment. Therefore, the coated sheets cannot be picked up individually, and the double feeding of sheets occurs.

The friction force exerted between the special sheets described above is equal to or smaller than the friction force for standard paper. However, in a low relative humidity environment, the attraction of resin sheets to each other is induced by an attractive force considerably stronger than the force generated by friction, and in a high relative humidity environment, the attraction of coated sheets to each other is induced by another attractive force that is considerably higher than the friction force. Therefore, the conventional separation system cannot perform individual sheet separation.

That is, since for the conventional sheet separation system only the friction force exerted between sheets is considered, this system cannot steadily separate individual sheets when an attractive force other than the friction force acts on sheets.

In order to eliminate the very high attractive force exerted between the sheets, conventionally, the printing industry and some copier manufacturers have adopted a sheet separation and feeding system as disclosed in Japanese Patent Application Laid-Open No. H11-005643. According to this system, individual sheets are raveled out in advance by blowing air against the side of a stack of sheets to remove attractions between sheets. In this state, the individual sheets are picked up, start with the uppermost, and are separated by a sheet separating portion located downstream. In the sheet separation and feeding system that comprises means (hereinafter referred to auxiliary raveling-out means) for blowing air against the side of a stack of sheets, the sheets (recording media) that tend to attract to each other are raveled out before the sheet feeding, and the attractions removed. Therefore, the efficiency of the sheet separation function is increased compared with the previously described system that relies only on the friction force. FIG. 18 is a diagram showing the configuration of a sheet feeding apparatus that includes such auxiliary raveling-out means. A sheet feeding apparatus 155 comprises: a sheet supply tray 59 on which sheets S are stacked; sheet feeding means (not shown), for feeding the sheets S from the sheet supply tray 59; air blowing means 71, for blowing air against the side of the stacked sheets S; and flow path moving means 157, for vertically moving the air blowing means 71 along the side of the stack of sheets S.

The flow path moving means 157 includes a guide rail (not shown), used to support the air blowing means 71 so it is movable vertically; an electric motor 121; and a cam plate 123, which contacts the lower face of the air blowing means 71 and moves the air blowing means 71 vertically. In the flow path moving means 157, when the electric motor 121 is rotated, the air blowing means 71 is moved vertically by the cam plate 123, and accordingly, an air channel is moved vertically. Since the opening (air blowing port) of the air blowing means 71 has a constant predetermined opening dimension, the side of the sheet S is exposed at the opening as the air blowing means 71 is lowered. Then, the dimension of the opening is reduced, and the direction in which air is blown from the opening is narrowed. As a result, the sheets P are floated beginning with the uppermost sheet S, and the attraction between all the sheets S is removed. Another example sheet separating and feeding system for blowing air against the side of a stack of sheets is disclosed in Japanese Patent Application Laid-Open No. 2001-048366. According to this system, blown air is heated by a heater to remove humidity from the sheets P in order to reduce the attractive force between the sheets (coated sheets), especially in a high relative humidity environment.

However, for a sheet feeding apparatus that employs the sheet separation and feeding system for blowing air against the side of a sheet stack, when air is blown, especially in a low relative humidity environment, only part of the stacked sheets close to the air blowing port is dried.

When the sheets are only partially dried, the surface resistance on the sheet plane is uneven, and as a result, when a sheet is fed to the image forming portion of the image forming apparatus, this dry portion causes a transfer failure, and an image defect occurs. Especially for an electrophotographic system wherein the image forming portion employs an electrostatic charge to transfer a toner image to a sheet, since the transfer function is greatly affected by the surface resistance of the sheet, the uneven surface resistance causes an uneven image transfer, so that considerable image deterioration occurs and the obtained image is very unsatisfactory.

SUMMARY OF THE INVENTION

While taking these shortcomings into account, it is one objective of the present invention to provide a sheet feeding apparatus that can steadily separate and feed individual sheets without causing an image detect, such as a transfer failure, and an image forming apparatus employing this sheet feeding apparatus.

According to one aspect of the present invention, a sheet feeding apparatus for feeding sheets, comprises:

sheet feeding means for feeding sheets stacked on elevatable sheet stacking means, air blowing means for blowing air against an end face of a sheet stack supported by the sheet stacking means;

sheet position detection means for detecting that a top face of the sheet stack has reached a sheet feeding position whereat a sheet feeding operation by the sheet feeding means is enabled, wherein, after a predetermined waiting time that a sheet is not actually fed by said sheet feeding means has elapsed since the sheet position detection means has detected that the top face of the sheet stack has reached the sheet feeding position, or since the sheet feeding means has finished the sheet feeding operation, the air blowing means starts an air blowing operation during a predetermined air blowing period.

According to another aspect of the invention, a sheet feeding apparatus for feeding sheets comprises:

a elevatable lifter support on which a stack of sheets is mounted;

a pickup roller for conveying the sheets from the lifter support;

an air blow opening located opposite an end face of the sheet stack mounted on the lifter support;

a fan for blowing air from the air blow opening; and a paper position sensor for detecting that a top face of an uppermost sheet of the sheet stack on said lifter support has reached a sheet feeding position whereat a sheet feeding operation is enabled, wherein, after a predetermined waiting time that a sheet is not fed by said pickup roller has elapsed since the paper position sensor has detected that the top face of the uppermost sheet on the sheet stack has reached the sheet feeding position, or since the pickup roller has finished the sheet feeding operation, the fan blows air during a predetermined air blowing period.

BRIEF DESCRIPTION OF THE DRAWINGS

FIG. 10 is a control table for controlling the initial swing time for the sheet feeding apparatus;

FIG. 11 is a control table for controlling a pre-job swing time for the sheet feeding apparatus;

FIG. 12 is a control table controlling the temperature of the heater of the sheet feeding apparatus;

FIG. 13 is a time control table for controlling a swing operation in the waiting state of the sheet feeding apparatus;

DESCRIPTION OF THE PREFERRED EMBODIMENTS

The preferred embodiment of the present invention will now be described in detail while referring to the accompanying drawings.

Figure 1:
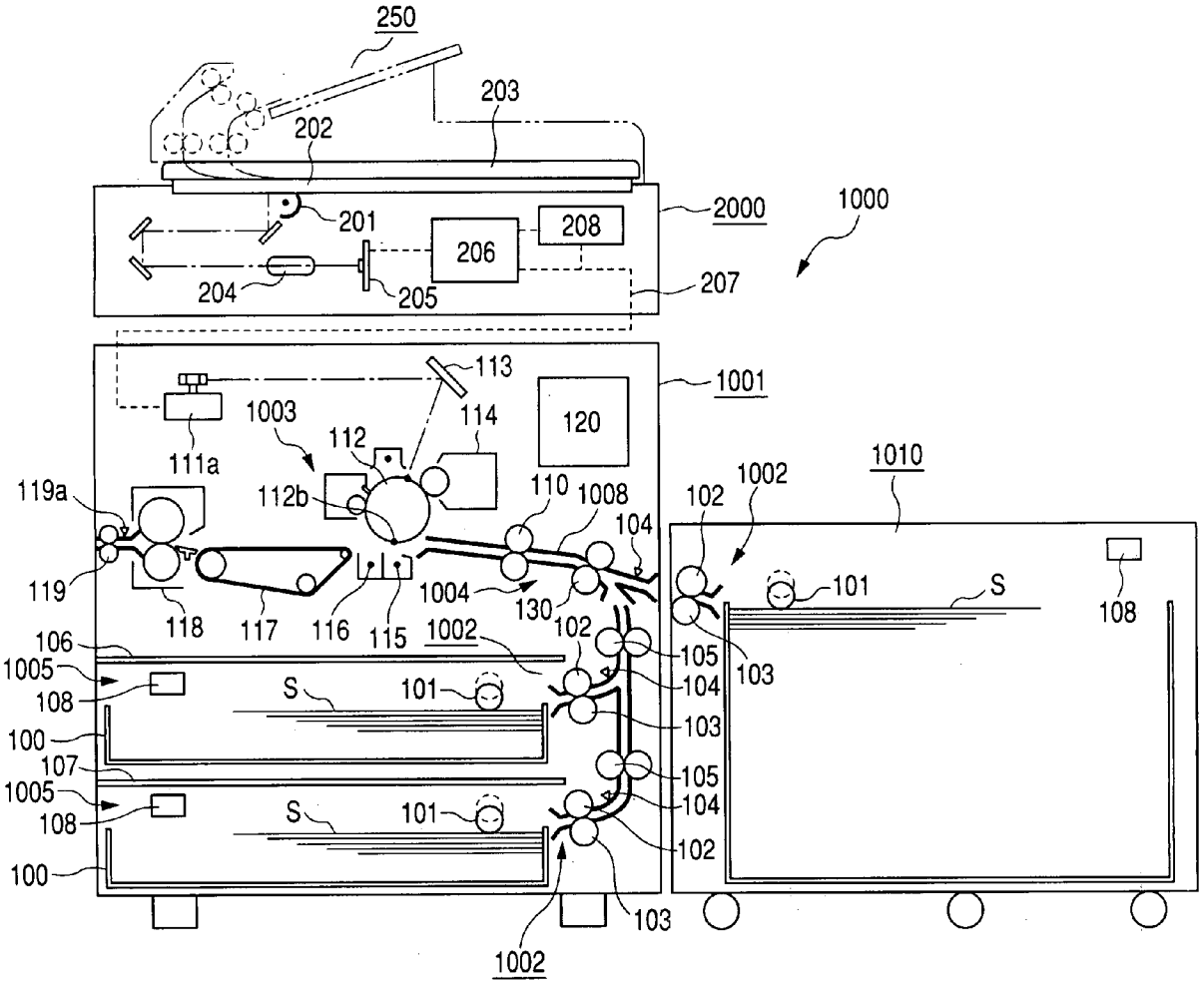
FIG. 1 is a cross-sectional view of a printer, an example image forming apparatus that includes a sheet feeding apparatus according to one embodiment of the present invention.

FIG. 1 is a cross-sectional view of a printer, an example image forming apparatus that includes a sheet feeding apparatus according to the embodiment of the invention.

In FIG. 1, a printer 1000 comprises a printer main body 1001 and a scanner 2000 arranged on the top face of the printer main body 1001.

The scanner 2000 for reading a document includes an optical scanning system light source 201, an original glass 2020, a document pressing plate 203 that is opened and closed, a lens 203, a light-receiving (photo-electric) device 205, an image processing portion 206, and a memory portion 208 used to store image processing signals obtained by the image processing portion 206.

To read a document, the optical scanning system light source 201 emits light to illuminate a document (not shown) placed on the original glass 202. The obtained document image is processed by the image processing portion 206, and is converted into an electric signal 207, which is an electrical code, and the electric signal 207 is transmitted to a laser scanner 111*a* that serves as image production means. The image data that are encoded by the image processing portion 206 may be temporarily stored in the memory portion 208, and in accordance with a signal transmitted by a controller 120, which will be described later, the image data may be transmitted to the laser scanner 111*a*, as needed.

The printer main body 1001 includes: a sheet feeding apparatus 1002, for feeding a sheet S; a sheet conveying apparatus 1004, for conveying, to an image forming portion 1003, the sheet S received from the sheet feeding apparatus 1002; and a controller 120, which serves as control means for the printer 1000.

The sheet feeding apparatus 1002 includes cassettes 100, pickup rollers 101, and separating portions constituted by feed rollers 102 and retard rollers 103. The sheets S in the cassettes 100 are separated individually and fed by the pickup rollers 101, which are elevated/rotated at a predetermined timing, and the separating portions. Further, sheet feeding sensors 104 are located downstream, in the sheet conveying direction, in the vicinities of the feed rollers 102 and the retard rollers 103. The sheet feeding sensors 104 detect the passage of sheets S.

Cassette storage portions 1005, wherein the cassettes 100 are stored, are provided in the lower portion of the printer main body 1001. Partitions 106 and 107 delimit the cassette storage portions 1005, and are closed at a predetermined tightness. Temperature and humidity sensors 108, which are provided for the individual cassettes 1005, are means for detecting the temperature and humidity in the vicinities of the cassettes 100 stored in the cassette storage portions 1005. These sensors 108 can independently detect the temperatures and humidities in the cassette storage portions 1005.

A large capacity paper deck 1010 is detachably mounted as an option. A sheet feeding apparatus 1002 and a lifter support (not shown) are provided for the paper deck 1010, as well as for the printer main body 1001. The paper deck 1010 is closed at a predetermined tightness, and a temperature and humidity sensor 108 is provided to detect the temperature and the humidity in the paper deck 1010.

The sheet conveying apparatus 1004 includes conveying roller pairs 105 and a registration roller portion constituted by a pre-registration roller pair 130 and a registration roller pair 110. A sheet S, fed by the sheet feeding apparatus 1002, is conveyed by the conveying roller pair 105 along a sheet conveying path 1008 formed by a guide plate, and is introduced to the registration roller pair 110. Thereafter, the sheet S is conveyed by the registration roller pair 110 to the image forming portion 1003.

The image forming portion 1003 includes a photosensitive drum 112, the laser scanner 111*a*, a developing device 114, a transfer charging device 115, and a separating charging device 116. For image forming, a laser beam emitted by the laser scanner 111*a* is reflected by a mirror 113 and projected onto an exposure position 112*a* on the photosensitive drum 112, which is rotated clockwise. As a result, a latent image is formed on the photosensitive drum 112 and is thereafter visualized as a toner image by the developing device 114.

The toner image on the photosensitive drum 112 is transferred to the sheet S at the transfer portion 112*b* by the transfer charging device 115. The sheet S bearing the toner image is then electrostatically separated from the photosensitive drum 112, by the separating charging device 116, and is conveyed along a conveying belt 117 to a fixing apparatus 118 to fix the toner image. Thereafter, the resultant sheet P is discharged by discharging rollers 119. A sheet discharging sensor 119*a*, which detects the passage of the sheet P that is to be discharged, is located along the conveying path extending between the fixing apparatus 118 and the sheet discharging roller 119.

In this embodiment, the printer main body 1001 and the scanner 2000 are separate members; however, they may be integrally formed. Regardless of whether the printer main body 1001 is separately or integrally formed with the scanner 2000, the printer main body 1001 can either function as a copier when the laser scanner 111*a* receives a signal from the scanner 2000 or as a facsimile machine when a facsimile signal is received, or can also function as a printer when a signal is received from a personal computer.

Further, when a signal obtained by the image processing portion 206 of the scanner 2000 is to be transmitted to another facsimile machine, the printer main body 1001 can also function as a facsimile machine. In addition, an automatic document feeding apparatus 250, indicated by a dashed double-dotted line, may be mounted instead of the pressing plate 203, so that a document can be automatically read.

Figure 2:
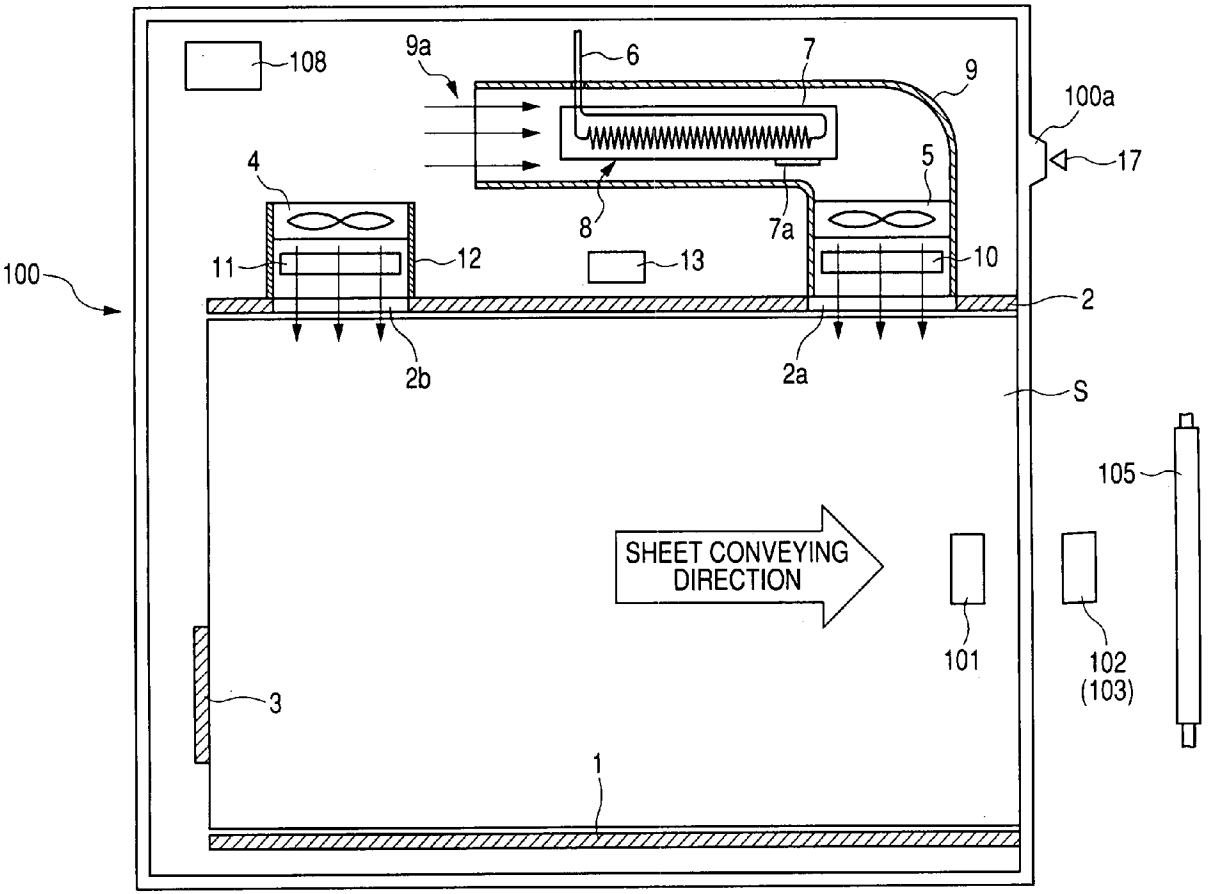
FIG. 2 is a plan view of the configuration of the sheet feeding apparatus.
Figure 3:
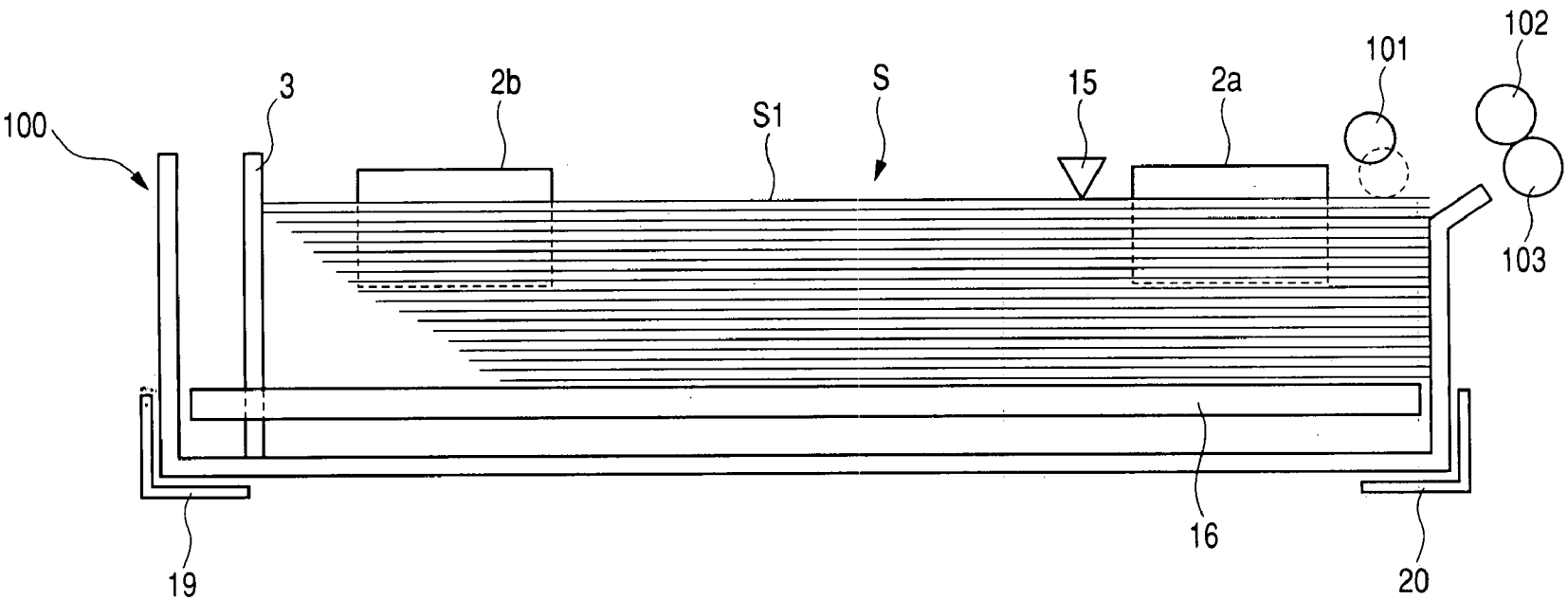
FIG. 3 is a side cross-sectional view of the sheet feeding apparatus.

FIG. 2 is a plan view of the configuration of the sheet feeding apparatus 1002, and FIG. 3 is a side cross-sectional view of the sheet feeding apparatus 1002. In this embodiment, the cassettes 100 are inserted into, or removed from the cassette storage portions 1005 in a widthwise direction, perpendicular to the sheet conveying direction.

In FIG. 2, side regulation plates 1 and 2 control the widthwise position of the sheets S stored in each of the cassettes 100, and can be displaced in the widthwise direction in accordance with the width of the sheets S. A rear end regulation plate 3 controls the position of the sheets S at the rear, in the sheet conveying direction, and can be displaced in the sheet conveying direction in accordance with the length of the sheets S.

The cassette 100 can be pulled along rails 19 and 20 in FIG. 3. When a user sets up the cassette 100, he or she need only pull the cassette 100 out from the front of the printer main body 1001. As is shown in FIG. 2, a protrusion 100*a* is formed for each cassette 100. When the cassette 100 is stored in the cassette storage portion 1005, the protrusion 100*a* is detected by a cassette attachment and detachment detection sensor 17 that is provided for the cassette storage portion 1005.

A detection signal obtained by the cassette attachment and detachment detection sensor 17 is transmitted to the controller 120, which employs the received detection signal to determine whether the cassette 100 is attached to the cassette storage portion 1005 or has been pulled out.

In each of the cassettes 100, as is shown in FIG. 3, a lifter support 16 is provided as elevatable sheet stacking means used to mount the sheets S. As the cassette 100 is inserted or removed, the lifter support 16 is elevated or lowered by a lifter motor 18 in FIG. 4.

For example, when a user stores a cassette 100 in which sheets S are mounted, and when the controller 120 detects this based on a signal received from the cassette attachment and detachment detection sensor 17, the controller 120 drives the lifter motor 18 to elevate the lifter support 16. Then, when the user pulls out the cassette 100 to set sheets S and the controller 120 detects this, based on a signal received from the cassette attachment and detachment detection sensor 17, and the controller 120 drives the lifter motor 18 to lower the lifter support 16 to a lower limit position.

At the upper portion of each of the cassette storage portions 1005, a sheet surface position detection sensor 15 is provided to determine whether the face of the uppermost sheet S1 mounted on the lifter support 16 is appropriately positioned for sheet feeding, i.e., to determine whether the face of the uppermost sheet has reached the sheet feeding position.

When the lifter support 16 is to be elevated, the rotation of the lifter motor 18 is continued until the sheet surface position detection sensor 15 detects the position of the face of the uppermost sheet S1. When the sheet surface position detection sensor 15 detects the uppermost sheet S1, the controller 120, based on a detection signal received from the sheet surface position detection sensor 15, halts the lifter motor 18. Through this processing, an appropriate height can be maintained for the sheet S1.

As the sheet feeding operation is initiated, the sheets S are sequentially fed, from the uppermost location, and as the height of the sheets is gradually reduced and the sheet surface position detection sensor 15 is turned off, the controller 120 drives the lifter motor 18 again to elevate the lifter support 16 Through-this processing, the height of the face of the uppermost sheet can be constantly controlled, within a predetermined range.

As is described above, for coated sheets, an attraction phenomenon occurs in high humidity. The clarification of an attraction mechanism, obtained by the present inventor, will now be explained.

Figure 5:
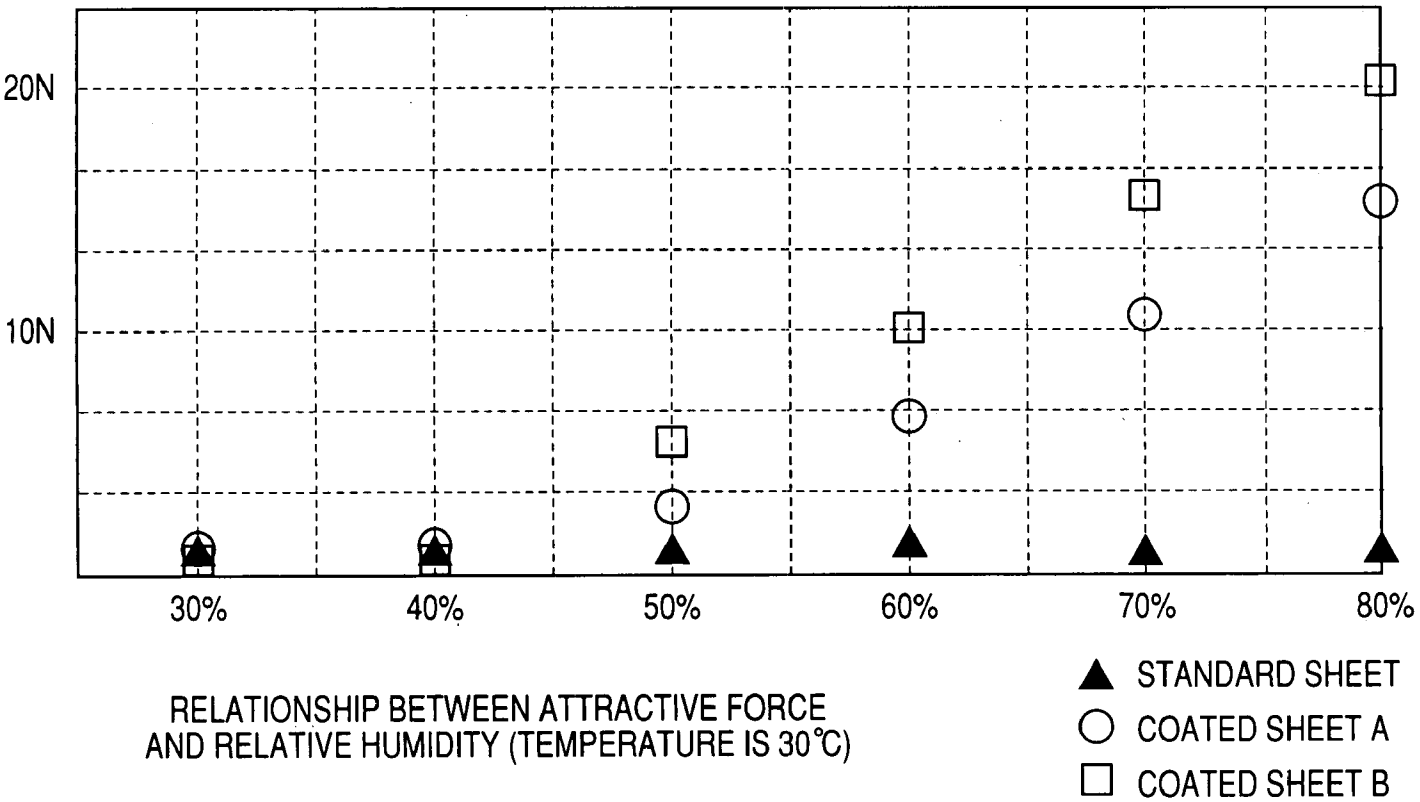
FIG. 5 is a graph showing-relationship between attractive force and relative humidity.

FIG. 5 is a graph showing the results of an attractive force measurement experiment conducted in advance in order to clarify the attraction mechanism. For the attractive force measurement experiment, the attractive forces for two types of coated sheets (coated sheets A and coated sheets B) and standard sheets were measured in different environments. In FIG. 5, the horizontal axis represents the relative humidity during the experiment and the vertical axis represents the attractive force, at a fixed temperature of 30° C.

As is apparent from in FIG. 5, the results obtained for the coated sheets A and B were extremely different from those for the standard sheets, and the attractive force readings for the coated sheets A and B depended very much on the humidity. In an environment wherein the relative humidity was 40% or lower, for all sheets, including the standard, almost no attractive forces occurred, while when the relative humidity exceeded 40%, the attractive forces increased linearly. The same measurements were conducted at temperatures of 20° C. and 40° C., and the same results were obtained. Based on the results, it was found that the attractive force for the coated sheets depended more on the relative humidity than on the absolute amount of water contained in the air.

Through various experiments conducted by the present inventor, the attraction mechanism for the coated sheets can be explicated as follows.

Figure 6A:
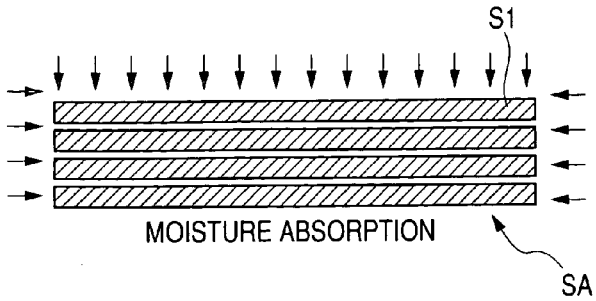
FIGS. 6A, 6B, 6C and 6D are diagrams for explaining an attractive mechanism for a coated sheet.
Figure 6B:
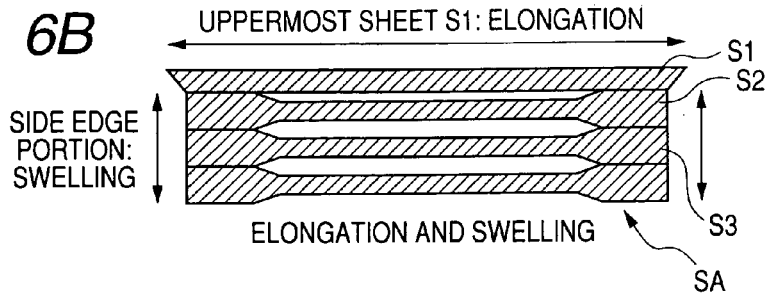

As is shown in FIG. 6A, when a sheet stack SA of coated sheets is exposed in a high relative humidity environment, moisture absorption occurs only on the obverse surface of the uppermost sheet S1 of the sheet stack SA and on the side edge portions. When moisture is absorbed, as is shown in FIG. 6B, the obverse surface of the uppermost sheet S1 is elongated and the side edge portions of the sheet stack SA swell.

Figure 6C:
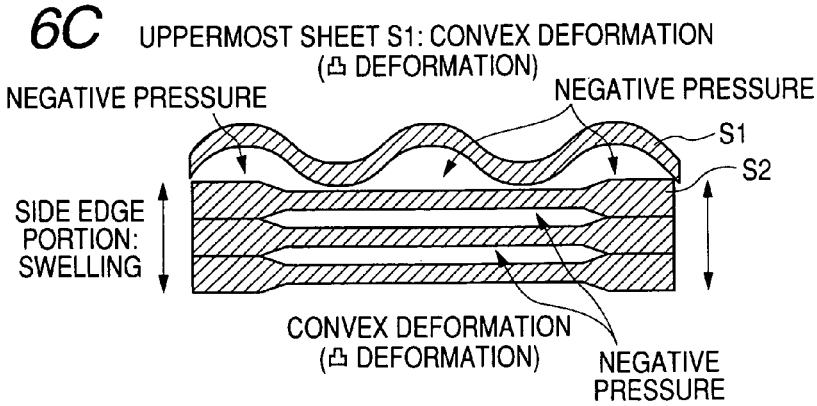

Since the reverse surface of the uppermost sheet S1 is less elongated than the obverse, as is shown in FIG. 6C, a convex deformation phenomenon of the uppermost sheet S1 occurs. While since the coated sheets are very smooth and do not transmit much air, substantially no air flows between the sheets. Therefore, when the convex deformation phenomenon of the uppermost sheet S1 occurs, a defined volume, between the uppermost sheet S1 and the second sheet S2, is increased, a negative pressure is generated, and the second sheet S2 is attracted to the uppermost sheet S1. This phenomenon is hereinafter called attraction to the attraction of the uppermost sheet through the absorption of moisture.

When the moisture absorption occurs on the side edge portions of the sheet stack SA for sheets other than the uppermost sheet S1, the center of the sheet stack SA does not swell while the side edge portions do. Thus, the volume is increased in the direction of the thickness of the sheets, and a negative pressure is generated between the sheets that causes the sheets to attract to each other. This phenomenon is hereinafter called attraction through moisture absorption by the side edge portions.

Figure 6D:
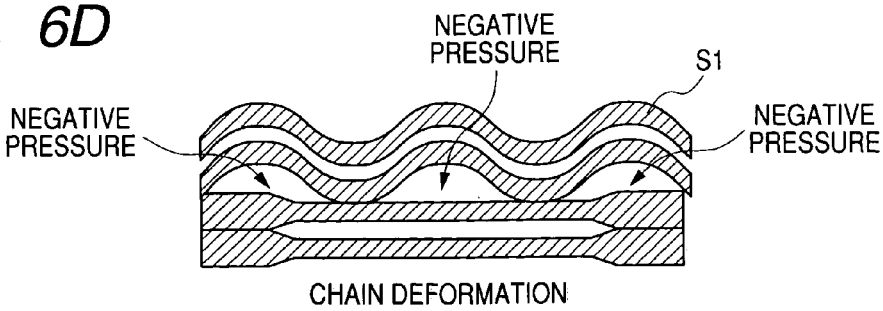

Furthermore, as is shown in FIG. 6D, when the convex deformation occurs on the second coated sheet S2 because of the convex deformation of the uppermost sheet S1, a negative pressure is generated between the second coated sheet S2 and the third coated sheet S3, and the sheets S2 and S3 attract to each other. This phenomenon is called attraction through chain deformation. The attraction through chain deformation may occur for several tens of sheets, from the third sheet down.

As is described above, for the coated sheet attraction mechanism in high relative humidity are three types of attraction phenomena, the attraction through moisture absorption by the uppermost sheet, the attraction through moisture absorption by the side edge portions, and the attraction through chain deformation. Since these three attraction phenomena are caused by the swelling or the elongation of the coated sheets through moisture absorption, and the generation of a negative pressure, the attraction phenomena can be prevented and negative pressure removed by the flow of air between the coated sheets. Further, since the temperature of the air flow is increased, the coated sheets can be dehumidified and dried, and protected from swelling, and the phenomenon, where coated sheets again attract to each other, can be prevented.

Therefore, according to the embodiment, as is shown in FIGS. 2 and 3 as previously explained, in the side regulation plate 2 that is located to the rear in the widthwise direction, a plurality (two in this embodiment) of air duct ports 2*a* and 2*b* are formed at a predetermined interval in the sheet conveying direction, and at a height that, at the least, corresponds to the side edge of the sheet S that is located at the position for sheet feeding. Ducts 9 and 12 are provided wherein fans 4 and 5, which are air flow means, are mounted, upstream of the air duct ports 2*a* and 2*b*. The fans 4 and 5 blow air onto the sheets S through the air duct ports 2*a* and 2*b*.

Between the fans 4 and 5 and the air duct ports 2*a* and 2*b*, shutters 10 and 11 are provided that are elevatable by a swing motor 13 and an elevating mechanism (not shown). As air is blown onto the sheets S, the shutters 10 and 11 are gradually swung vertically to direct the air so that it sequentially flows between the sheets S, and the effect produced by raveling-out the sheets is increased.

Figure 4:
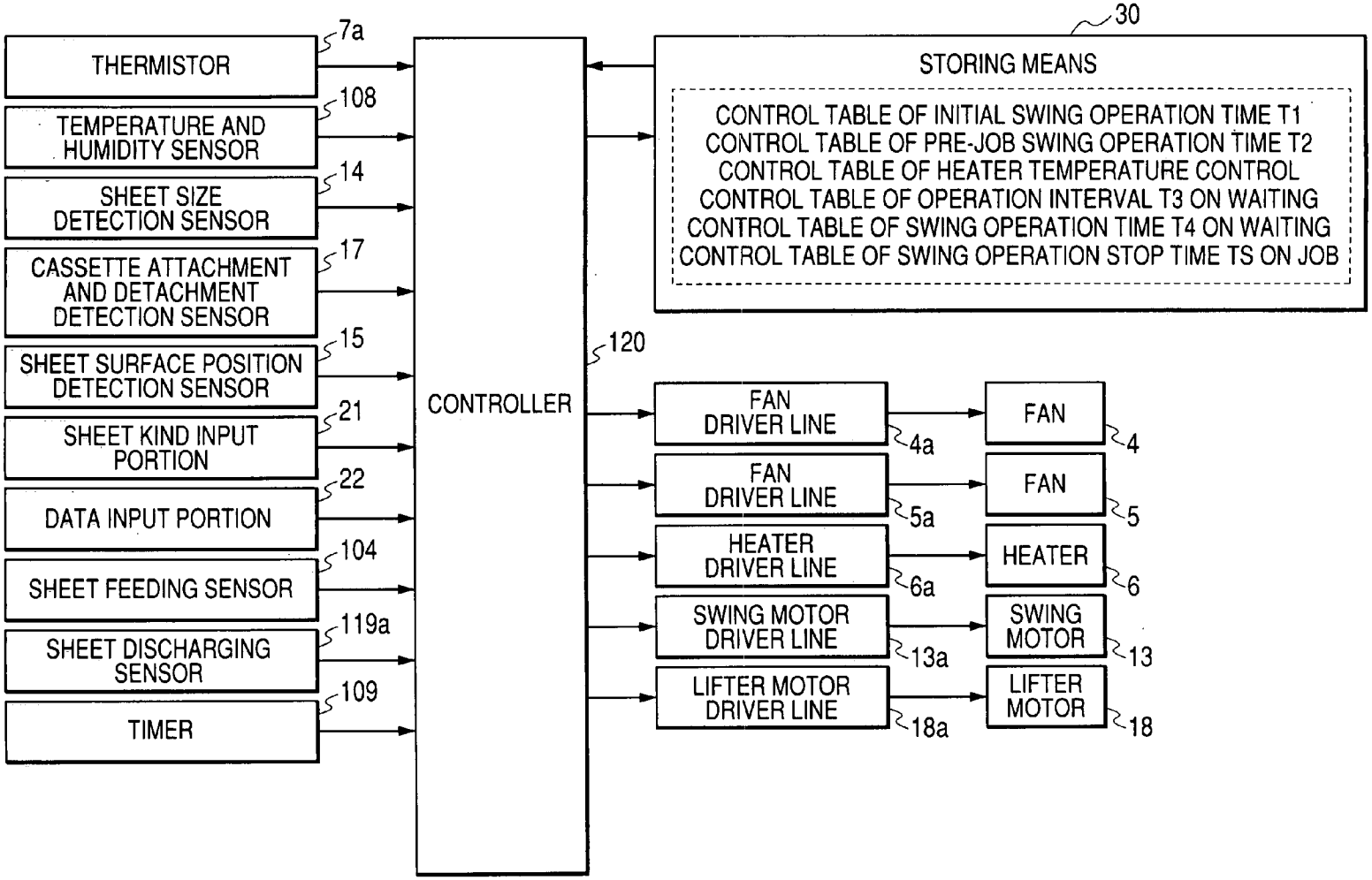
FIG. 4 is a block diagram showing the printer.

The fans 4 and 5 and the swing motor 13 are independently driven in accordance with signals transmitted, by the controller 120, via fan driver circuits 4*a* and 5*a* and a swing motor driver circuit 13*a* shown in FIG. 4.

Furthermore, as is shown in FIG. 2, air heating means 8, which includes a heater 6 and a heat sink 7, is provided near an air inlet 9*a* for the duct 9 that leads to the air duct port 2*a* on the pickup roller side. The air heating means, which is located upstream in the direction in which the fan 5 blows air, heats air supplied through the air inlet 9*a* in the direction indicated by arrows, and expels warm air through the air duct port 2*a*.

A thermistor 7*a* is attached to the heat sink 7 to detect the temperature of the surface of the heat sink 7, and a detection signal is transmitted by the thermistor 7*a* to the controller 120, as is shown in FIG. 4. In accordance with the detection signal received from the thermistor 7*a*, the controller 120, via the driver circuit 6*a*, turns the heater 6, of the air heating means 8, on or off, so as to adjust the temperature of the warm air supplied through the air duct port 2*a*.

As is shown in FIG. 2, the fans 4 and 5, the ducts 9 and 12, the air heating means 8 and the shutters 10 and 11 are integrally attached to the side regulation plate 2 located to the rear in the widthwise direction. With this arrangement, when sheets S having the size shown in FIG. 2 are exchanged for smaller sheets S2 shown in FIG. 7, the fan 5 and the other components are moved, together with the side regulation plate 2 located to the rear in the widthwise direction, so that the positional relationship, relative to the ends of the sheets S2, can be continuously maintained.

Figure 7:
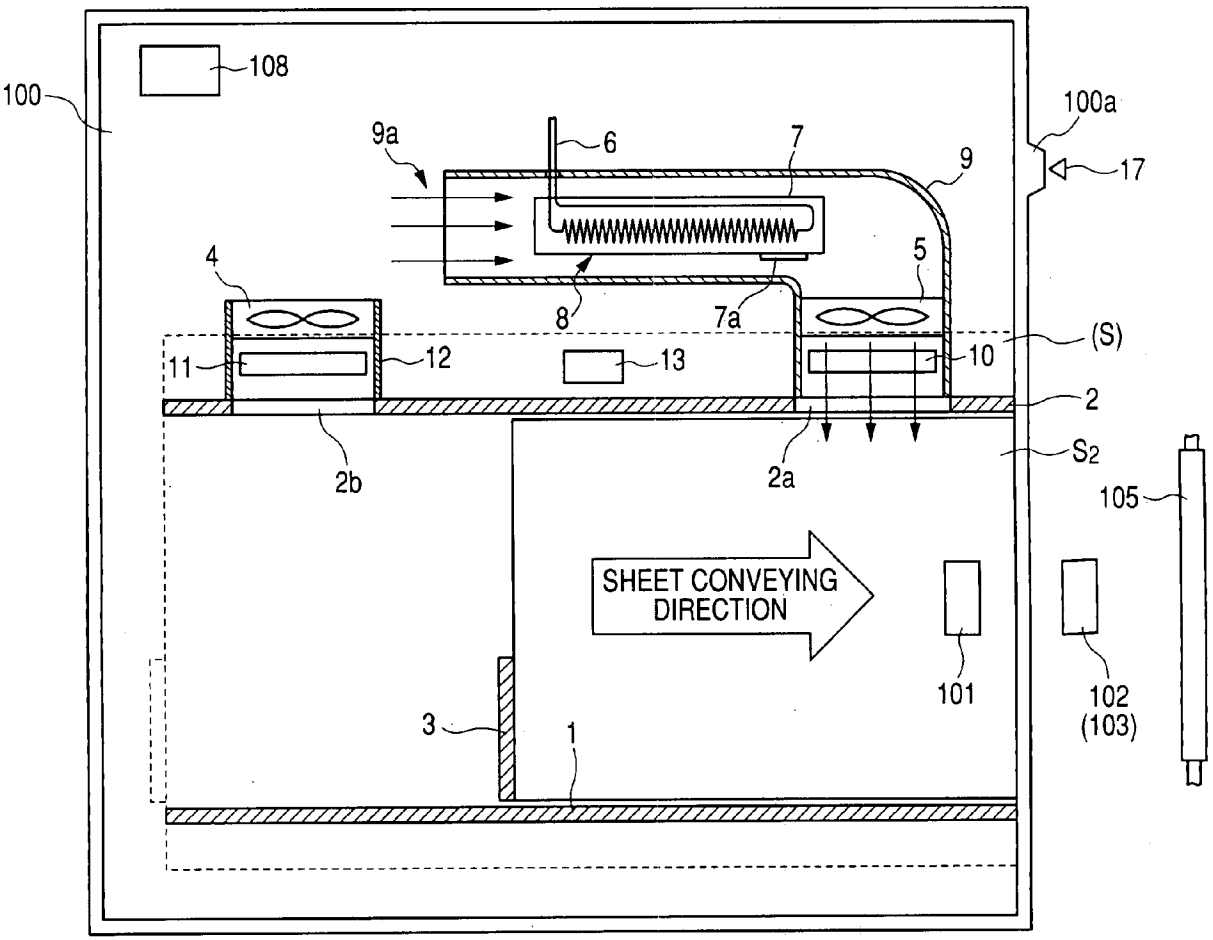
FIG. 7 is a plan view of the state wherein small sheets are stored in the sheet feeding apparatus.

In this case, when the rear ends of sheets S, such as the small sheets S2 shown in FIG. 7, do not reach the air duct port 2*b* located downstream in the sheet conveying direction, and when the fan 4 is driven, the air supplied by the fan 4 is wasted.

Figure 14:
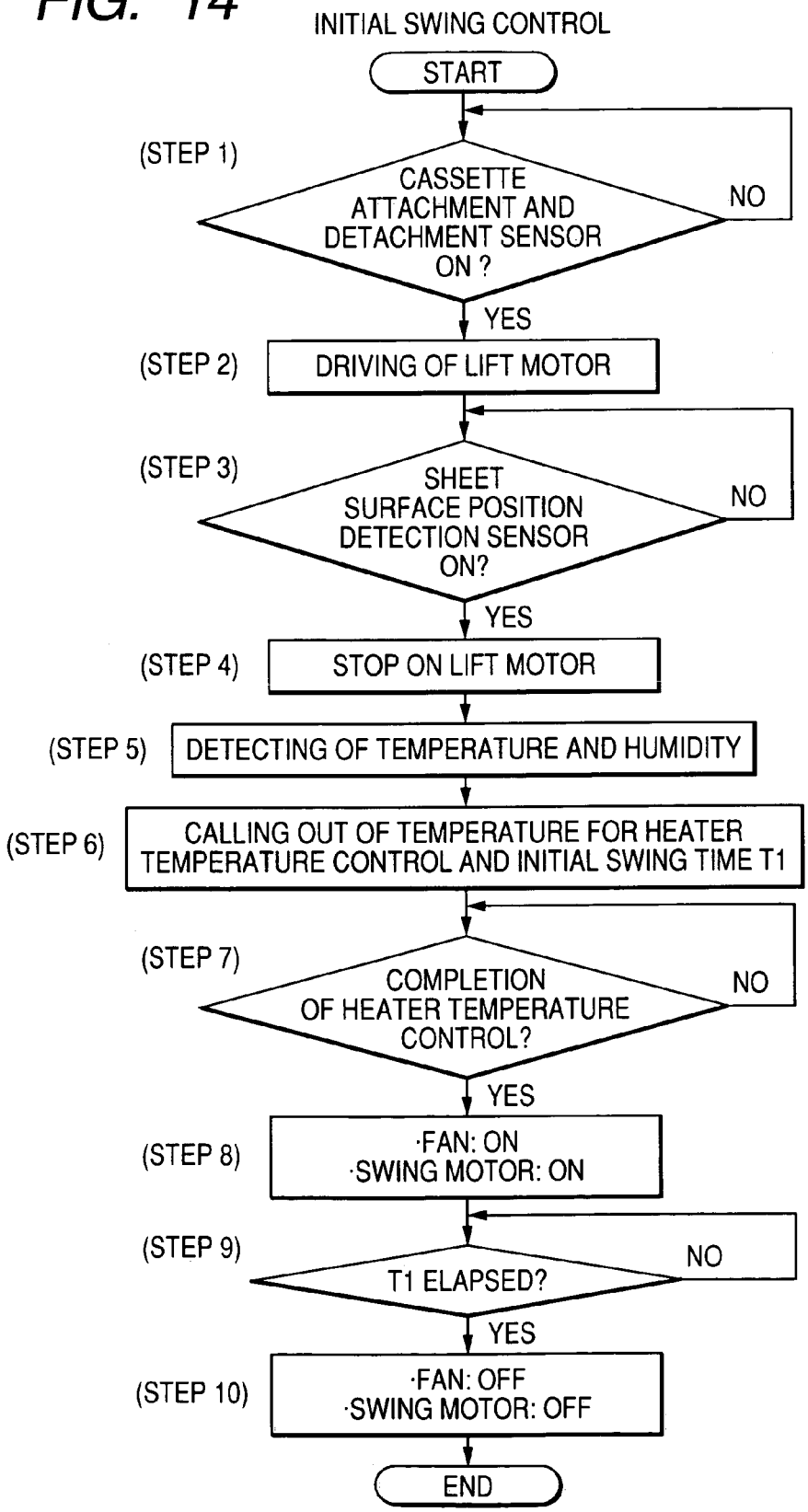
FIG. 14 is a flowchart showing the initial swing operation of the sheet feeding apparatus.

Therefore, a sheet size detection sensor 14, as shown in FIG. 14, is provided for the cassette 100 to detect the sheet size in accordance, for example, with the locations of the side regulation plates 1 and 2 and the rear end regulation plate 3. And when, in accordance with a sheet size data signal received from the sheet size detection sensor 14, the controller 120 determines the sheets S stored in the cassette 100 are small, it independently halts the fan 4.

Through this process, a negative pressure is eliminated by flowing air between the sheets S, and the temperature of the air is increased to dehumidify and dry the wet, coated sheets, to prevent them from swelling and to prevent the occurrence of attraction.

The present inventor found through an experiment that, as the characteristic of the coated sheets, the attractive force reached its highest level immediately after a package of coated sheets was opened.

Figure 8:
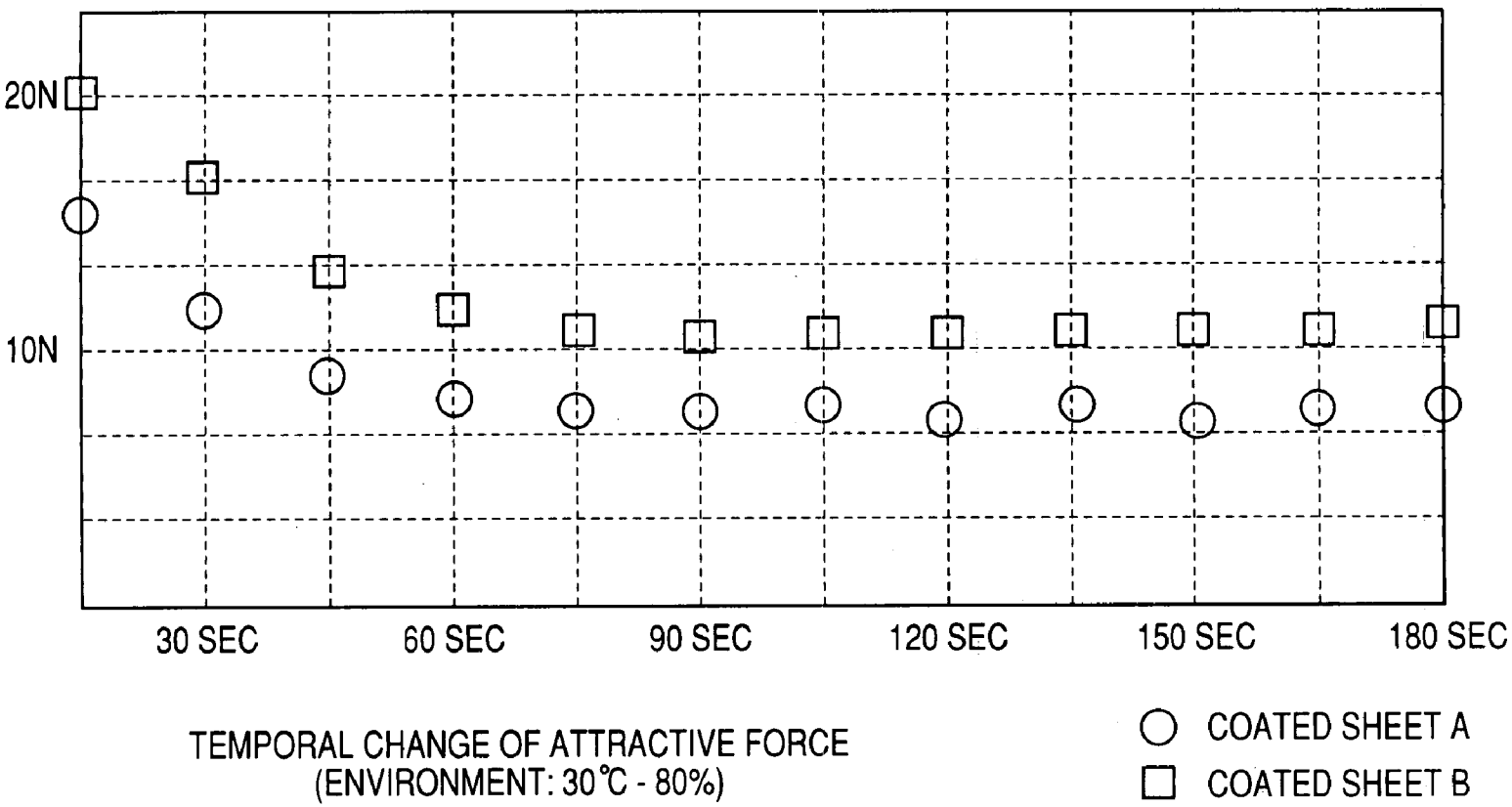
FIG. 8 is a graph showing the temporal change of an attractive force immediately after a package of coated sheets is opened.

FIG. 8 is a graph showing data obtained by measuring the temporal change in the attractive force of the coated sheets immediately after a package of the coated sheets was opened. In FIG. 8, the vertical axis represents attractive force, and the horizontal axis represents time. The environment for the measurement was a temperature of 30° C. and a relative humidity of 80%.

As is apparent from the measurement results shown in FIG. 8, the attractive force of the coated sheets is highest immediately after the package is opened, and gradually reduces as time elapses. That is, the attractive force of coated sheets is highest immediately after a cassette 100, in which coated sheets have been stored by a user, has been loaded into the cassette storage portion 1005. The attraction phenomenon is hereafter called attraction immediately after a package of coated sheets is opened.

Figure 9:
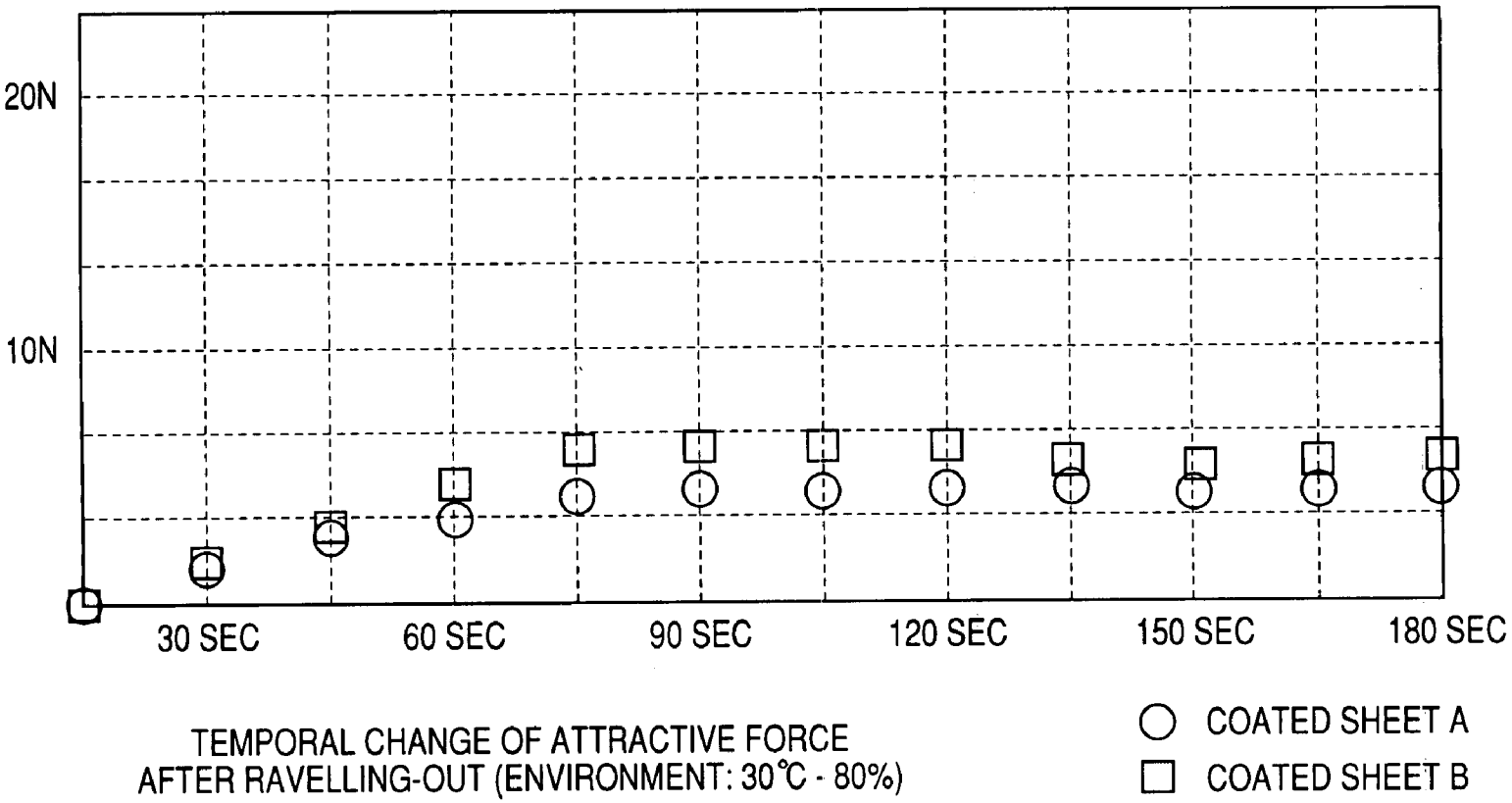
FIG. 9 is a graph showing the temporal change of the attractive force after the coated sheets are raveled out.

Next, the present inventor supplied air at a high temperature to coated sheets that were attracted to each other, raveling-out the sheets, and measured the temporal change in the attractive force. FIG. 9 is a graph showing data obtained by measuring the temporal change in the attractive force in a state wherein the attractive force was released. In FIG. 9, the vertical axis represents the attractive force and the horizontal axis represents time.

As is apparent from the measurement results shown in FIG. 9, the attractive force is eliminated immediately after the sheets are raveled out; however, the re-attraction of sheets is begun as time elapses, and a considerably high attractive force is generated, although it is not as high as the attractive force immediately after a package is opened. Hereinafter, this attraction phenomenon is called re-attraction occurring as time elapses. The present inventor found that re-attraction occurring-as time elapses and attraction immediately after a package was opened also cause double feeding and erroneous feeding.

Furthermore, in order to examine the affect on an image (transfer performance) when a coated sheet is partially dried using air at a high temperature, the present inventor blew warm air at 45° C. onto a coated sheet for one minute at a temperature of 30° C. and a relative humidity of 80%, and at a temperature of 5° C. and a relative humidity of 10%, and measured the water content in part of the coated sheet. As a result, in the environment at a temperature of 30° C. and a humidity of 80%, uneven water content was almost not observed, while in the environment at a temperature of 5° C. and a humidity of 10%, a considerably uneven water content was observed.

Further, when the image forming portion 1003 transferred an image to the coated sheet used in the environment at a temperature of 30° C. and a humidity of 80%, no problems occurred. However, when the image was transferred to the coated sheet used in the environment at a temperature of 5° C. and a humidity of 10%, the transfer performance was deteriorated at the portion having a small water content, and a satisfactory density could not be obtained.

That is, through the experiment performed by the present inventor, in an environment at a high temperature and a high humidity, the coated sheets absorb considerably moisture, and image forming is not affected by raveling-out these sheets using air at a high temperature. However, since the coated sheets do not attract to each other in an environment at a low temperature and a low humidity, the sheets need not be raveled out by air blown at a high temperature, and if air is blown onto the sheets, an image defect occurs.

The present inventor also found that an image detect due to a transfer failure in the low humid environment was correlated not only with the temperature of the air, but also with the period air was blown and the air flow rate.

Based on these obtained results, in this embodiment, the following arrangement is employed.

Since the coated sheets tend to attract to each other immediately after a package is opened, when a cassette 100 is loaded into the cassette storage portion 1005, and when the surface of the uppermost coated sheet is detected by the sheet surface detection sensor 14, i.e., when the stack of coated sheets reaches a position for sheet feeding, air blown to fan the sheets for a predetermined time T1 is enough. This operation is hereinafter called the initial swing operation.

Furthermore, before the sheet feeding is initiated, air is blown for a predetermined time T2 to sufficiently fan the sheets, This operation is hereinafter called a pre-job swing operation.

In addition, as is described above, since the coated sheets strongly attract to each other in a high relative humidity environment, and do not attract in a low relative humidity environment, the temperature of the heater 6 must be designated in accordance with the environment.

When a predetermined period, i.e., a period beginning after a cassette 100 is loaded into the cassette storage portion 1005 and is raised to the position for sheet feeding, and continuing until the sheet feeding operation is started, or a period beginning after that, since the sheet feeding operation initiated and continued until the next sheet feeding operation is started is long, the sheets may not be appropriately raveled out by the pre-job swing operation.

In this embodiment, therefore, a waiting operation interval T3, which is an operating interval time (waiting time) for the swing operation in the waiting state, is determined in accordance with the detection results obtained by the temperature and humidity sensor 108. When the waiting operation interval T3 has elapsed, air is blown during a waiting swing operation time T4. This operation is hereinafter called a swing operation on waiting. When the swing operation on waiting is repeated until the sheet feeding operation is started, the re-attraction as time elapses, which occurs while the sheet feeding apparatus 1002 is in the waiting state, can be eliminated.

FIGS. 10 to 13 are control tables for optimal air blowing periods (the initial swing time T1 and the pre-job swing time T2), the temperature of air (temperature adjusted by the heater 6), the waiting operation interval T3, the waiting swing operation time T4, and a halt time T5 for the swing operation, during a job that will be described later, all of which the prevent inventor defined while taking into account the affect of the transfer performance in each environment wherein the sheet feeding apparatus 1002 was employed.

The air blowing period control table for the initial swing operation and the pre-job swing operation, the heating temperature control table and the swing operation control table, which is a time control table shown in FIGS. 10 to 13, and a fan air flow rate control table (not shown) are stored in storage means 30 in FIG. 4.

When a sheet type input portion 21 included in an operating portion in FIG. 4 is employed, for example, to enter coated sheets to be stored in the cassette 100, and when the cassette 100 is loaded into the cassette storage portion 1005, the initial swing operation is performed for the predetermined time T1 in accordance with the environmental condition of the cassette storage portion 1005 or the cassette 100.

For resin sheets, such as OHP or art films, since attraction immediately after a package is opened or re-attraction as time elapses does not occur in a high relative humidity environment, the initial swing operation, the pre-job swing operation and the swing operation in the waiting state need not be performed. Further, since the attraction mechanism for these sheets is attraction due to charging, the air need not be heated by the heater 6. Therefore, a period required for temperature adjustment to be completed by the heater 6 can be removed.

Further, since standard sheets do not originally attract to each other, raveling-out of these sheets using air is not required during the sheet feeding operation. As is described above, since the initial swing operation, the pre-job swing operation, the swing operation in the waiting state, and the temperature control operation by the heater 6 are not performed if not necessary, the FCOT is quickly ready, and for a user, the usability of a printer can be increased.

The initial swing operation will now be described while referring to a flowchart in FIG. 14.

When the cassette 100 is loaded into the cassette storage portion 1005, and when the cassette attachment and detachment detection sensor 17 detects this and is in the ON state (Y at step 1), the controller 120 rotates the lift motor 18 to raise the lifter support 16 (step 2). Then, the level of the sheet stack is gradually raised, together with the lifter support 16, until the sheet surface position detection sensor 15 detects the surface of the uppermost sheet and is set in the ON state (Y at step 3) Thereafter, the lift motor 18 is halted (step 4)

Next, the temperature and humidity sensor 108 detects the temperature and the humidity in the cassette storage portion 1005 (or the cassette 100) (step 5), and based on the temperature and humidity reading thus obtained, data for the temperature of the heater 6 and the initial swing time T1 are read from the control tables shown in FIGS. 10 and 12 (step 6). Then, to adjust the temperature of the heater 6, the heater 6 is rendered conductive via the heater driver circuit 6*a* (see FIG. 4).

When the temperature control operation performed by the heater 6 is completed (Y step 7), the fans 4 and 5 and the swing motor 13 are turned on (step 8). Following which, when the initial swing time T1 obtained from the control table has elapsed (Y at step 9), the fans 4 and 5 and the swing motor 6 are turned off (halted) (step 10).

Through this processing, immediately after a package of coated sheets is opened, warm air can be blown onto the coated sheets to remove attractions, so that the coated sheets can be appropriately raveled out. As a result, a reliable sheet feeding apparatus can be provided that prevents the occurrence of a paper jam or double feeding. In addition, since the initial swing time T1 and the adjusted temperature are designated based on the optimal tables that have been determined, through experiment, to establish both the coated sheet raveling-out capability and the image quality, image deterioration, such as a transfer failure, does not occur.

When there is a possibility that the coated sheets are not appropriately raveled out during the initial swing operation, the job start instruction may be rejected until the initial swing operation has been completed, or a job may be started after the job start instruction has been accepted and the initial swing operation has been completed.

While referring to a flowchart in FIG. 15, an explanation will now be given for the pre-job swing operation performed before the sheet feeding operation is started in order to eliminate the occurrence of re-attraction as time elapses.

When a user depresses a job start button, first, the temperature and humidity sensor 108 detects the temperature and the humidity in the cassette storage portion 1005 (the cassette 100) (step 21), and based on the obtained temperature and humidity, data for the pre-job swing time T2 and the adjusted temperature for the heater 6 are read from the control tables in FIGS. 11 and 12 (step 22).

Thereafter, the controller 120 renders the heater 6 conductive to adjust the temperature of the heater 6, and when the temperature control operation for the heater 6 has been completed (Y at step 23), the fans 4 and 5 and the swing motor 13 are turned on to perform the pre-job swing operation (step 24). When the pre-job swing time T2 obtained from the control table has elapsed (Y at step 25), the sheet feeding operation is initiated (step 26). And when a predetermined job is terminated, i.e., when the final sheet for the job has been fed (Y at step 27), the fans 4 and 5 and the swing motor 13 are turned off (halted) (step 28).

Through this processing, before the sheet feeding operation is initiated for coated sheets that have been exposed from a package for a while; warm air can be blown onto the coated sheets to eliminate re-attraction, and the coated sheets can be appropriately raveled out.

Next, while referring to the flowchart in FIG. 16, an explanation will be given for the swing operation in the waiting state performed when there has been a long sheet feeding waiting time. The swing operation in the waiting state in FIG. 16 is performed for a long waiting time when the period since the cassette 100, loaded in the cassette storage portion 1005, reached a sheet feeding enabled position until the sheet feeding operation began is extended.

When the above described initial swing operation in FIG. 14 has been completed, based on the temperature and humidity obtained by the temperature and humidity sensor 108, the controller 120 reads, from the time control table in FIG. 13, the predetermined waiting operation interval T3, following which the swing operation in the waiting state is started in accordance with the temperature and humidity, and the waiting swing operation time T4, which is a predetermined time during which the swing operation in the waiting state is performed (step 31). Then, the controller 120 renders the heater 6 conductive via the heater driver circuit 6*a* to adjust the temperature of the heater 6.

Following this, a time 109 (see FIG. 4) is activated (step 32), and the start of the sheet feeding operation is waited for (step 33). Specifically, the controller 120 waits until the user depresses the job start button. When the sheet feeding operation is not begun (N at step 33), and when the waiting operation interval T3 has elapsed (Y at step 34), the fans 4 and 5 and the swing motor 13 are turned on (step 35). Thereafter, when the waiting swing operation time T4 previously obtained from the time control table has elapsed (Y at step 36), the fans 4 and 5 and the swing motor 13 are turned off (halted) (step 37).

Figure 15:
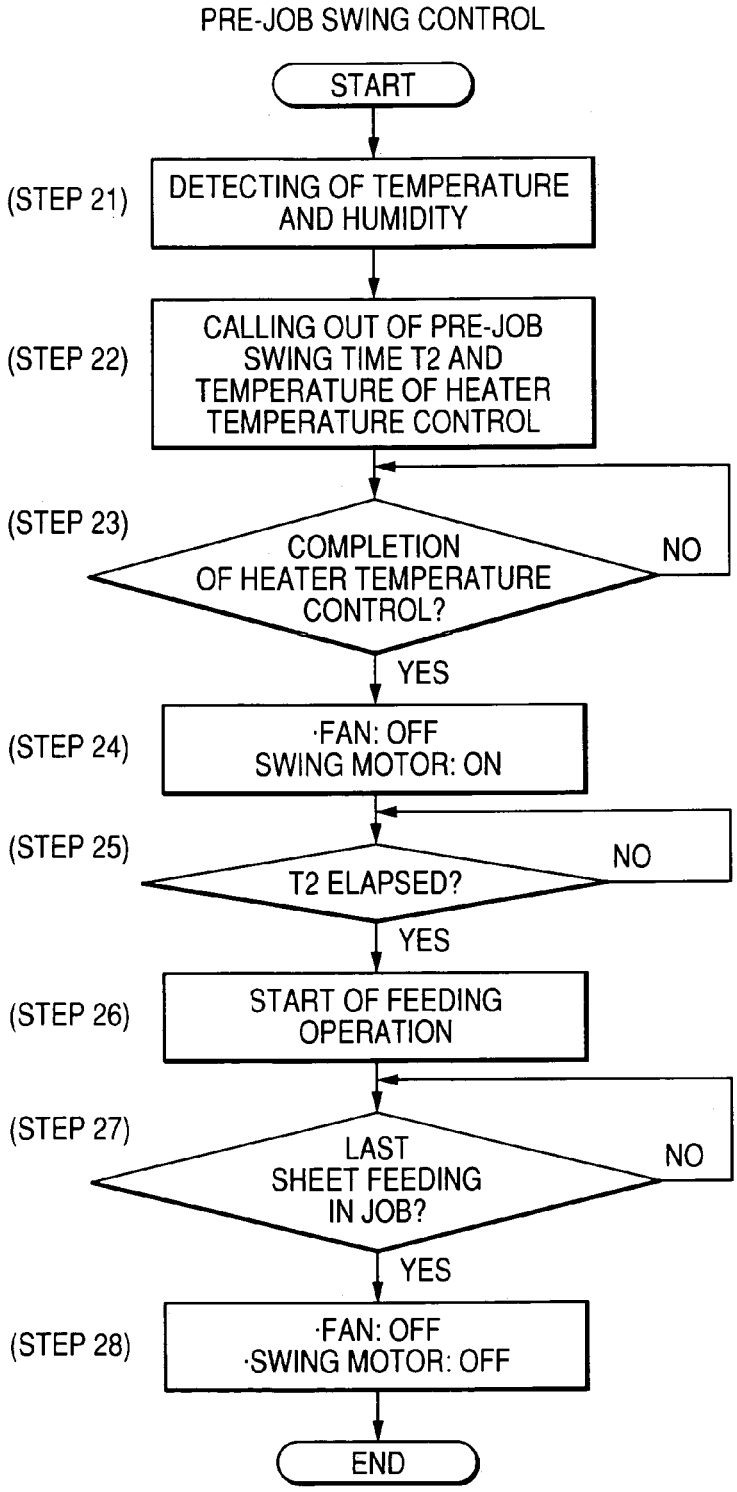
FIG. 15 is a flowchart showing the pre-job swing operation of the sheet feeding apparatus.
Figure 16:
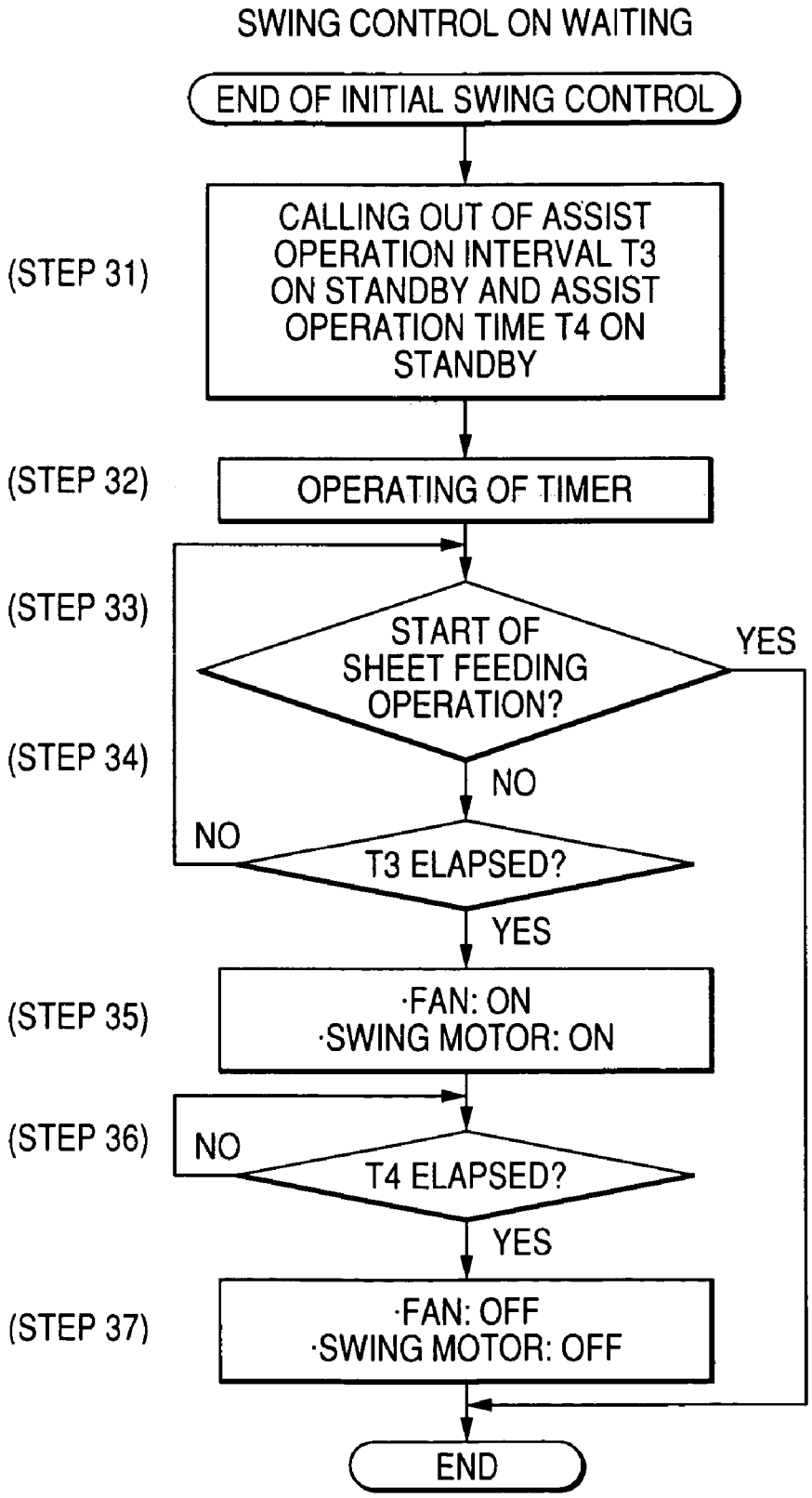
FIG. 16 is a flowchart showing the swing control, in the waiting state, for the sheet feeding apparatus.

For a case wherein there is a long waiting time since a sheet feeding operation was performed before the next sheet feeding operation is started, at step 27 in FIG. 15, the final sheet for the job is fed, at step 28, the fans 4 and 5 and the swing motor 6 are turned off, and the controller 120 performs the same process as in FIG. 16. The swing operation in the waiting state is repeated until the sheet feeding operation is initiated.

Figure 17:
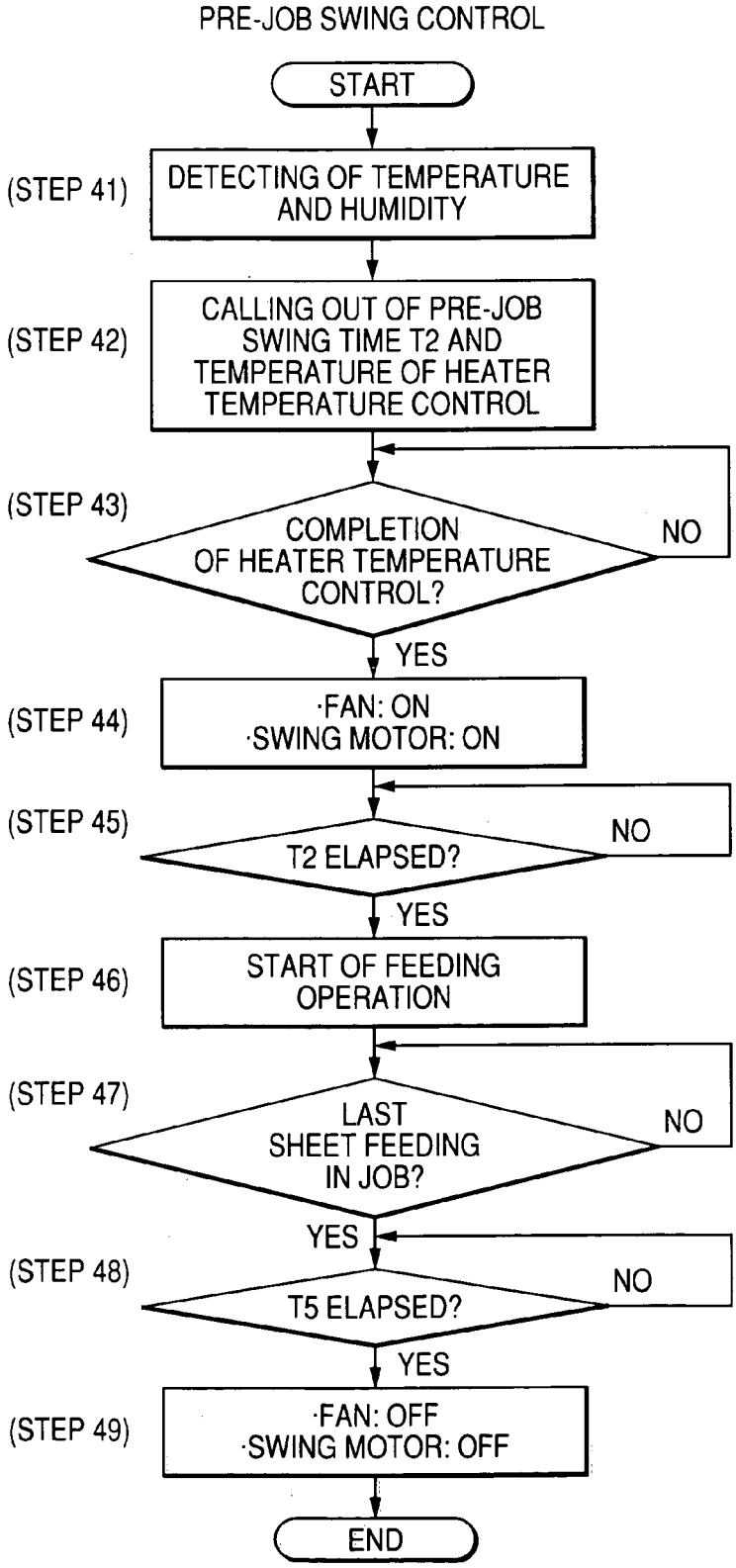
FIG. 17 is a flowchart showing the pre-job swing operation for the sheet feeding apparatus performed after the swing operation in the waiting state has been performed.
Figure 18:
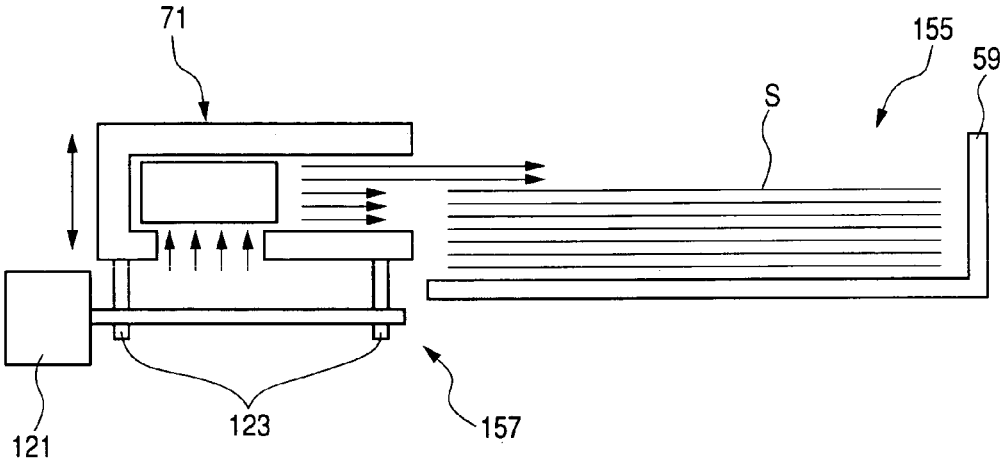
FIG. 18 is a diagram for explaining the configuration of a conventional sheet feeding apparatus.

Furthermore, the pre-job swing operation and the sheet feeding operation shown in the flowchart in FIG. 17 may be performed. The processes at steps 41 to 47 in FIG. 17 are the same as those at steps 21 to 27 in FIG. 15.

In the flowchart in FIG. 17, after a predetermined job has been terminated, i.e., after the final sheet for the job has been fed, and when, at step 48, the job swing operation halt time T5, which is obtained from the time control table, has elapsed (Y at step 48), the fans 4 and 5 and the swing motor 13 are turned off (step 49).

Since the fans 4 and 5 and the swing motor 13 are halted after the job swing operation halt time T5 has elapsed, the coated sheets can be appropriately and smoothly raveled out in the next pre-job swing operation.

As is described above, when a predetermined waiting time that a sheet is not fed has elapsed since it was detected that the sheets had reached the sheet feeding enabled position, or since the sheet feeding operation was finished, the air blowing operation need only be performed during a predetermined period to eliminate the attraction between the sheets that occurs while waiting for the sheet feeding operation. Thus, an image defect, such as an image failure, does not occur, and various types of sheets, such as coated sheets, OHP sheets, art films and very thick paper sheets, can be individually separated and fed. Further, the next sheet feeding operation can be performed smoothly. For each swing operation, only the air blowing operation may be performed while the vertical movements of the shutters 10 and 13 are halted.

In addition, since the temperature for the heater 6 is set in accordance with a signal received from the temperature and humidity sensor 108 located near the cassette 100, a satisfactory sheet feeding function and a high-quality image, without a defect such as an image failure, can be provided.

In this embodiment, the operation for the coated sheets has been explained in detail. However, the present invention is not limited to the coated sheets, and control tables may be prepared for OHP films, art films, very thick paper and other standard paper, in addition to the coated sheets for which the characteristic differs depending on the environment.

For example, as is described above, for an OHP file or an art film, since attraction in a low relative humidity environment occurs as a result of charging, air must be blown at a high flow rate in a low relative humidity environment, while since in a high relative humidity environment attraction by charging almost does not occur, air can be blown at a low flow rate. Further, since resin sheets do not absorb water, warm air is not required, and therefore, the heater can be turned off. In addition, since re-attraction as time elapses does not occur for these types of sheets, the swing operation in the waiting state need not be performed.

For very thick paper, the conveying resistance is increased by its own weight, and a pickup failure occurs. Thus, environmental dependency is not present, and the blowing of air is required in all environments. Further, since the attraction by moisture absorption does not occur for very thick paper, as well as the OHP, warm air is not required, and the heater can be turned off. Furthermore, since re-attraction as time elapses does not occur, the swing operation in the waiting state is not required.

As is described above, the optimal control tables for the heater temperature, the air flow rate and the air blowing period may be prepared for each type of sheet material, the sheet type input portion 21 shown in FIG. 4 may be provided as sheet type input means, and the controller 120 may select and employ one of the time control tables in accordance with the sheet type data obtained from the sheet type input portion 21. Further, since the attractive characteristic and the transfer characteristic differ depending on the type and brand of coated sheet, optimal control tables may be provided for each type and brand. Thus, a more reliable sheet feeding apparatus can be provided.

Furthermore, a data input portion 22 in FIG. 4 may be provided to rewrite data in the time control table or the temperature control table, or to add a new table, and a user or a maintenance person may employ the data input portion 22 to freely create and store each of the above described control tables in accordance with the purpose.

In this embodiment, the fans 4 and 5 and the air duct ports 2*a* and 2*b* are located on the side (at one end in the direction of the width of a sheet) of a sheet stack that is mounted on the lifter support 16, and the air is blown onto the side end of the sheet stack. However, the present invention is not limited to this arrangement, and can be applied for a configuration wherein air duct ports are provided to the front, in the direction in which the mounted sheets are fed, and air is blown onto the front end of the sheet stack.

Furthermore, since the initial swing operation, the pre-job swing operation and the swing operation in the waiting state are performed for the sheet deck, a image defect such as an image failure does not occur, and the individual sheets can be appropriately separated and fed.

Further, although in this embodiment the retard system has been employed as sheet separating means, a Duplo system or an air feeding system may be employed.

This application claims priority from Japanese Patent Application No. 2003-301028 filed on Aug. 26, 2003, which is hereby incorporated by reference herein.

What is claimed is:

1. A sheet feeding apparatus for feeding sheets, comprising:

sheet feeding means for feeding sheets stacked on elevatable sheet stacking means, air blowing means for blowing air against an end face of a sheet stack supported by said sheet stacking means; and sheet position detection means for detecting that a top face of said sheet stack has reached a sheet feeding position whereat a sheet feeding operation to feed the sheet by said sheet feeding means is enabled, wherein, when the sheet feeding operation by the sheet feeding means is not started even if a predetermined waiting time from when said sheet position detection means has detected that said top face of said sheet stack has reached said sheet feeding position has elapsed, said air blowing means starts an air blowing operation and blows air during a predetermined air blowing period, and when the sheet feeding operation is started before the predetermined waiting time has elapsed, said air blowing means does not start the air blowing operation.

2. A sheet feeding apparatus according to claim 1, wherein, each time said predetermined waiting time has elapsed, said air blowing means performs the air blowing operation during said predetermined air blowing period.

3. A sheet feeding apparatus for feeding sheets comprising:

an elevatable lifter support on which a stack of sheets is mounted;

a pickup roller for feeding said sheets from the lifter support;

an air duct port located opposite an end face of said sheet stack mounted on said lifter support;

a fan for blowing air from said air duct port;

a paper position sensor for detecting that a top face of an uppermost sheet of said sheet stack on said lifter support has reached a sheet feeding position whereat a sheet feeding operation to feed the sheet is enabled; and a controller wherein, when the sheet feeding operation by said pickup roller is not started even if a predetermined waiting time from when said paper position sensor has detected that said top face of said uppermost sheet on said sheet stack has reached said sheet feeding position has elapsed, said fan blows air during a predetermined air blowing period, and when the sheet feeding operation is started before the predetermined waiting time has elapsed, said fan does not start to blow air.

4. A sheet feeding apparatus for feeding sheets, comprising:

sheet feeding means to perform a sheet feeding operation for feeding sheets stacked on elevatable sheet stacking means, and air blowing means for blowing air against an end face of a sheet stack supported by said sheet stacking means;

wherein, when the sheet feeding operation by said sheet feeding means is not started even if a predetermined waiting time after said sheet feeding means has finished the sheet feeding operation has elapsed, said air blowing means starts an air blowing operation and blows air during a predetermined air blowing period, and when the sheet feeding operation is started before the predetermined waiting time has elapsed, said air blowing means does not start the air flowing operation.

5. A sheet feeding apparatus according to claim 4, wherein, each time said predetermined waiting time has elapsed, said air blowing means performs the air blowing operation during said predetermined air blowing period.

6. A sheet feeding apparatus for feeding sheets comprising:

an elevatable lifter support on which a stack of sheets is mounted;

a pickup roller to perform a sheet feeding operation for conveying said sheets from the lifter support;

an air duct port located opposite an end face of said sheet stack mounted on said lifter support;

a fan for blowing air from said air duct port; and a controller wherein, in case that the sheet feeding operation by said pickup roller is not started even if a predetermined waiting time after the pickup roller has finished the sheet feeding operation has elapsed, said fan blows air against the end face of the sheet stack through the air duct port during a predetermined air blowing period, and in case that the sheet feeding operation is started before the predetermined waiting time has elapsed, said fan does not start to blow air.

7. An image forming apparatus comprising:

an image forming portion for forming an image on a sheet; and a sheet feeding apparatus according to one of claims 1, 2, 3, and 4–6 for feeding said sheet to said image forming portion.

8. A sheet feeding apparatus for feeding sheets, comprising:

a sheet feeding member capable of feeding sheets stacked on a sheet stacking member;

an air blowing member capable of blowing air against an end face of a sheet stack supported by said sheet stacking member; and wherein, when a sheet feeding operation by said sheet feeding member is not started in a predetermined waiting time in which the sheet feeding operation is ready, said air blowing member starts to blow air against the end face of a sheet before the sheet feeding operation is started, and when the sheet feeding operation is started in the predetermined waiting time, said air blowing member does not start to blow air.

9. A sheet feeding apparatus according to claim 8, wherein each time the predetermined waiting period has elapsed, said air blowing member performs the air blowing.

* * * * *

UNITED STATES PATENT AND TRADEMARK OFFICE

CERTIFICATE OF CORRECTION

PATENT NO. : 7,140,605 B2 
APPLICATION NO. : 10/916557
DATED : November 28, 2006
INVENTOR(S) : Takeshi Suga et al.

It is certified that error appears in the above-identified patent and that said Letters Patent is hereby corrected as shown below:

COLUMN 1:
Line 51, “can not” should read --cannot--.
Line 57, “then” should read --them--.

COLUMN 4:
Line 4, “showing-relationship” should read --showing relationship--.

COLUMN 7:
Line 10, “support 16” should read --support 16.--..

COLUMN 9:
Line 65, “occurring-as” should read --occurring as--.

COLUMN 10:
Line 23, “considerably” should read --considerable--.
Line 46, “sheets,” should read --sheets.--.

COLUMN 11:
Line 57, “step 3)” should read --step 3).--.
Line 58, “(step 4)” should read --(step 4).--.

COLUMN 12:
Lien 48, “while;” should read --while,--.
Line 59, “above described” should read --above-described--.

COLUMN 14:
Line 32, “above described” should read --above-described--.

COLUMN 15:
Line 53, “flowing” should read --blowing--.

UNITED STATES PATENT AND TRADEMARK OFFICE

CERTIFICATE OF CORRECTION

PATENT NO. : 7,140,605 B2
APPLICATION NO. : 10/916557
DATED : November 28, 2006
INVENTOR(S) : Takeshi Suga et al.

It is certified that error appears in the above-identified patent and that said Letters Patent is hereby corrected as shown below:

COLUMN 16:
Line 28, "claims 1, 2," should read --claims 1-6,--.
Line 29, "3, and 4-6" should be deleted.

Signed and Sealed this

Seventeenth Day of July, 2007

JON W. DUDAS
*Director of the United States Patent and Trademark Office*